US008963721B2

(12) United States Patent
Harris et al.

(10) Patent No.: US 8,963,721 B2
(45) Date of Patent: Feb. 24, 2015

(54) HAND HYGIENE COMPLIANCE DEVICE

(75) Inventors: Howard B. Harris, Indianapolis, IN (US); Michael A. Kaplan, Lafayette, IN (US); Todd Phillip Wayne Fricke, New Albany, IN (US)

(73) Assignee: Harkap Partners, LLC, Lafayette, IN (US)

( * ) Notice: Subject to any disclaimer, the term of this patent is extended or adjusted under 35 U.S.C. 154(b) by 636 days.

(21) Appl. No.: 13/069,700

(22) Filed: Mar. 23, 2011

(65) Prior Publication Data

US 2011/0234407 A1 Sep. 29, 2011

Related U.S. Application Data

(60) Provisional application No. 61/316,655, filed on Mar. 23, 2010.

(51) Int. Cl.
*G08B 23/00* (2006.01)
*G08B 21/24* (2006.01)

(52) U.S. Cl.
CPC ..... *G08B 21/245* (2013.01)
USPC ..... 340/573.1

(58) Field of Classification Search
CPC ..... G08B 21/245; G08B 21/22; G08B 3/10; G06F 19/327; A47K 5/12; A47K 5/1217; G06Q 10/00; G06Q 50/20; G06Q 50/22
See application file for complete search history.

(56) References Cited

U.S. PATENT DOCUMENTS

| | | | | |
|---|---|---|---|---|
| D274,887 | S | 7/1984 | Ryder | |
| 4,896,144 | A | 1/1990 | Bogstad | |
| 5,202,666 | A | 4/1993 | Knippscheer | |
| 5,810,201 | A | 9/1998 | Besse et al. | |
| 6,082,586 | A | 7/2000 | Banks | |
| 6,126,089 | A | 10/2000 | Williamson et al. | |
| 6,236,317 | B1 | 5/2001 | Cohen et al. | |
| 6,325,245 | B1 * | 12/2001 | Matthews | 222/52 |
| 6,392,546 | B1 | 5/2002 | Smith | |
| 6,394,315 | B1 | 5/2002 | Banks | |
| 6,404,837 | B1 | 6/2002 | Thompson et al. | |
| 6,426,701 | B1 | 7/2002 | Levy et al. | |
| 6,577,240 | B2 | 6/2003 | Armstrong | |

(Continued)

FOREIGN PATENT DOCUMENTS

| | | |
|---|---|---|
| EP | 0963728 | 12/1999 |
| EP | 1913892 | 4/2008 |
| WO | WO 2008/133495 | 11/2008 |

OTHER PUBLICATIONS

International Preliminary Report on Patentability for PCT/US2011/029573, mailed on Oct. 4, 2012, 8 pgs.

(Continued)

*Primary Examiner* — Brian Zimmerman
*Assistant Examiner* — Thomas McCormack
(74) *Attorney, Agent, or Firm* — Reichel IP LLP; Mark C. Reichel; Natalie J. Dean

(57) ABSTRACT

A device, system, and method of ensuring hand hygiene compliance is provided including a device for dispensing hygiene maintenance material that also monitors a detection zone to determine if an individual is present. The device, system, and method provide reminders and tracking of use of the dispensing device and the relation of that use compared to a desired use profile.

22 Claims, 6 Drawing Sheets

(56) References Cited

U.S. PATENT DOCUMENTS

| | | | | |
|---|---|---|---|---|
| 6,707,873 | B2 | 3/2004 | Thompson et al. | |
| 6,727,818 | B1 | 4/2004 | Wildman et al. | |
| 6,882,278 | B2 | 4/2005 | Winings et al. | |
| 6,883,563 | B2 | 4/2005 | Smioth | |
| 6,975,231 | B2 | 12/2005 | Lane et al. | |
| D513,387 | S | 1/2006 | Limbert | |
| D533,742 | S | 12/2006 | Matthews et al. | |
| 7,236,097 | B1 | 6/2007 | Cunningham | |
| 7,242,307 | B1 | 7/2007 | LeBlond et al. | |
| 7,271,728 | B2 | 9/2007 | Taylor et al. | |
| 7,372,367 | B2 | 5/2008 | Lane et al. | |
| 7,375,640 | B1 * | 5/2008 | Plost | 340/573.1 |
| 7,408,470 | B2 | 8/2008 | Wildman et al. | |
| 7,410,937 | B2 | 8/2008 | Grascha et al. | |
| 7,425,900 | B2 | 9/2008 | Lynn et al. | |
| 7,443,305 | B2 | 10/2008 | Verdiramo | |
| 7,477,148 | B2 | 1/2009 | Lynn et al. | |
| 7,495,569 | B2 | 2/2009 | Pittz | |
| 7,612,027 | B2 | 11/2009 | Grasha et al. | |
| 7,683,018 | B2 | 3/2010 | Koivisto et al. | |
| 2002/0135486 | A1 * | 9/2002 | Brohagen et al. | 340/573.1 |
| 2006/0067545 | A1 | 3/2006 | Lewis et al. | |
| 2006/0067546 | A1 | 3/2006 | Lewis et al. | |
| 2008/0001763 | A1 | 1/2008 | Raja et al. | |
| 2008/0087719 | A1 | 4/2008 | Sahud | |
| 2008/0100441 | A1 | 5/2008 | Prodanovich et al. | |
| 2008/0103636 | A1 | 5/2008 | Glenn et al. | |
| 2008/0246599 | A1 | 10/2008 | Hufton et al. | |
| 2009/0051545 | A1 * | 2/2009 | Koblasz | 340/573.1 |
| 2009/0195385 | A1 * | 8/2009 | Huang et al. | 340/572.1 |

OTHER PUBLICATIONS

International Search Report and Written Opinion for PCT Application No. PCT/US2011/029573, issued Dec. 21, 2011, 12 pgs.

Bacheldor, "RFID Debuts as Hand-Washing Compliance Officer, "RFID Journal, © 2005, 2 pgs.

Alpha Clean™ Compliance System, retrieved from www/alphaprosolutions.com, at least as early as Mar. 16, 2009, 2 pgs.

* cited by examiner

HAND HYGIENE COMPLIANCE DEVICE

CROSS-REFERENCE TO RELATED APPLICATIONS

This application claims the benefit of U.S. Provisional Application Ser. No. 61/316,655, filed Mar. 23, 2010, the disclosure of which is expressly incorporated herein by reference.

BACKGROUND AND SUMMARY OF THE DISCLOSURE

The present disclosure relates to a dispenser of hand hygiene maintenance material. More specifically, the present disclosure relates to a dispenser of hand hygiene maintenance material that provides reminders and tracking of use of the dispenser and the relation of that use compared to a desired use pattern.

Healthcare-associated infections remain one of the most significant sources of morbidity and mortality among hospital patients worldwide. In the United States there are an estimated 1.7 million healthcare-associated infections in hospitals resulting in approximately 80-100,000 deaths each year adding $4.5 to $5.7 billion to patient care costs. (Jarvis W R. Selected aspects of the socioeconomic impact of nosocomial infections: morbidity, mortality, cost and prevention. Infect Control Hospital Epidemiology, 1996:August 17(8):552-557). Transmission of healthcare-associated pathogens most often occurs via the contaminated hands of health care workers due to failure to use proper hand washing technique or failure to hand wash altogether before every patient contact. Compliance rates for basic hand washing techniques have been cited between about 25-50%. Failure to remember to comply with hand washing protocol prior to every patient contact is probably the most significant factor for low compliance rates. Other factors including understaffing and overcrowding further exacerbate this problem.

Recognizing a worldwide need to improve hand washing in health care facilities the World Health Organization (WHO) launched its "Guidelines on Hand Hygiene in Health Care (Advanced Draft) in October 2005. These global consensus guidelines reinforce the need for multidimensional strategies as the most effective approach to promote hand hygiene. Key elements include adoption of alcohol-based hand rub as the primary method for hand hygiene and the use of performance indicators to assess the compliance with hand washing policies. Presently, the only routine monitoring of compliance involves direct visual observation of hand hygiene by hospital personnel. In the CDC's monograph (MMWR. Oct. 25, 2002. 51(RR16); 1-44) many recommendations are indicated. These include: 1) to develop a device to facilitate the use and optimal application of hand hygiene agents, 2) to monitor hand hygiene adherence by ward or service staff and 3) to provide feedback to personnel regarding staff performance using the new device.

One study by Pittet et al (Pittet D, Hugonnet S et al. Effectiveness of a hospital-wide program to improve compliance with hand hygiene. Lancet, 2000; 356:1307-1312) showed a definite association between improved hand hygiene compliance and a decreased incidence of hospital acquired nosocomial infections, including methicillin-resistant staphylococcus aureus (MRSA) infections. Another study by Pittet et al (Pittet D, Simon A et al. Hand hygiene among physicians: performance, beliefs and perceptions. Ann Intern Med 2004; 148w) found that easy access to alcohol-based hand rub was an independent predictor of improved hand hygiene compliance. In addition, 8 out of 9 hospital-based studies from 1977-2000 clearly demonstrate a temporal relationship between improved hand hygiene and reduced nosocomial infection rates, especially MRSA.

Another very recent incentive to reduce hospital-acquired infections was a new rule imposed by Medicare on Oct. 1, 2008 which stated their refusal to pay hospitals for catheter-associated urinary tract and vascular catheter-associated infections. It is likely that private insurance companies will soon put this same rule into effect. Both types of infections could be reduced by adequate hand washing technique. (O'Grady N P, Alexander M et al. Guidelines for the prevention of intravascular catheter-related infections. Pediatr 2002: ppe51) and could save hospitals millions of dollars in reimbursements.

Visitors who do not use adequate hand washing techniques and then have direct contact with patients are another possible source of hospital acquired infections. This potential problem needs to be addressed and resolved as well.

The device of the present disclosure records hand hygiene compliance for all individuals who enter a monitored room. The recorded data can then be utilized to track compliance of a particular unit/ward to allow targeted training to improve compliance on that unit/ward. Immediate follow up data can then be supplied about the efficiency of the training. It can also track data at night and on weekends, when the presently used visual observation is not routinely used.

According to a first embodiment, the present disclosure includes a hygiene compliance device including a housing; a hygiene maintenance material holder located within the housing; an interface member coupled to the housing that, when activated by a user, causes distribution of hygiene maintenance material from within the hygiene maintenance material holder to the user; an interface member sensor coupled to the housing that detects activation of the interface member; a signal emitter coupled to the housing; a signal sensor coupled to the housing that cooperates with the signal emitter to detect the presence of a person in a detection zone; a circuit board located within the housing and coupled to the signal emitter, the signal sensor, and the interface member sensor, the circuit board including a processor; and a data storage unit located within the housing and electrically coupled to the processor. The data storage unit has instructions thereon that, when interpreted by the processor cause the processor to perform the steps of: issuing commands to the signal emitter to emit a signal; receiving data from the signal sensor; processing the data received from the signal sensor to determine if an individual is located within a detection zone of the sensor; detecting activation of the interface member sensor; determining if the interface member sensor is activated within a first preset time of a detection of an individual within the detection zone; and choosing between and executing one of: logging a compliant event by saving a record to the data storage unit if the interface member is activated within the first preset time of the detection of the individual in the detection zone; and issuing an alert detectable by the individual if the interface member is not activated within the first preset time of the detection of the individual in the detection zone.

According to a second embodiment, a method of monitoring hygiene compliance including the steps of: providing a hygiene compliance device to a hygiene sensitive location; providing for communication between the hygiene compliance device and a network; providing an adjustable signal emitter in the hygiene compliance device to monitor an ingress/egress point to the hygiene sensitive location; the hygiene compliance device further having a processor and a data storage unit. The data storage unit has instructions thereon, that when interpreted by the processor, cause the processor to perform the steps of: issuing commands to the signal emitter to emit a signal; receiving data indicative of the presence or lack of presence of an individual proximate the monitored ingress/egress point; processing the data received to determine if an individual is located within a detection zone of the sensor; detecting dispensing of hygiene compliance material from the hygiene compliance device; determining if the hygiene maintenance material is dispensed within a first preset time of a detection of an individual proximate the detection zone; and choosing between and executing one of: logging a compliant event by saving a record to the data storage unit if the interface member is activated within the first preset time of the detection of the individual in the detection zone; and issuing an alert detectable by the individual if the interface member is not activated within the first preset time of the detection of the individual in the detection zone.

Additional features of the present disclosure will become apparent to those skilled in the art upon consideration of the following detailed description of the illustrative embodiment exemplifying the best mode as presently perceived.

DETAILED DESCRIPTION

The embodiments of the disclosure described herein are not intended to be exhaustive or to limit the invention to precise forms disclosed. Rather, the embodiment selected for description have been chosen to enable one skilled in the art to practice the disclosure.

Figure 1A:
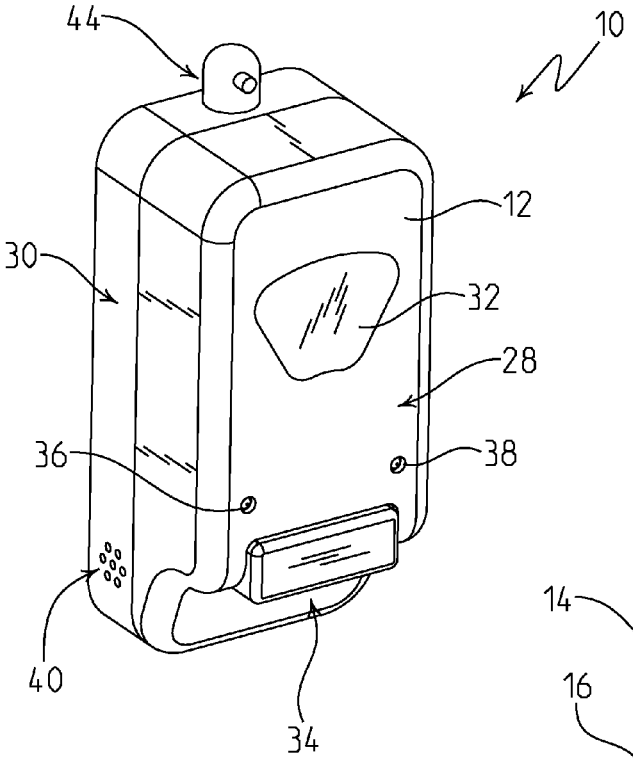
FIGS. 1*a&b* are perspective views of a hygiene maintenance device of the present disclosure.
Figure 1B:
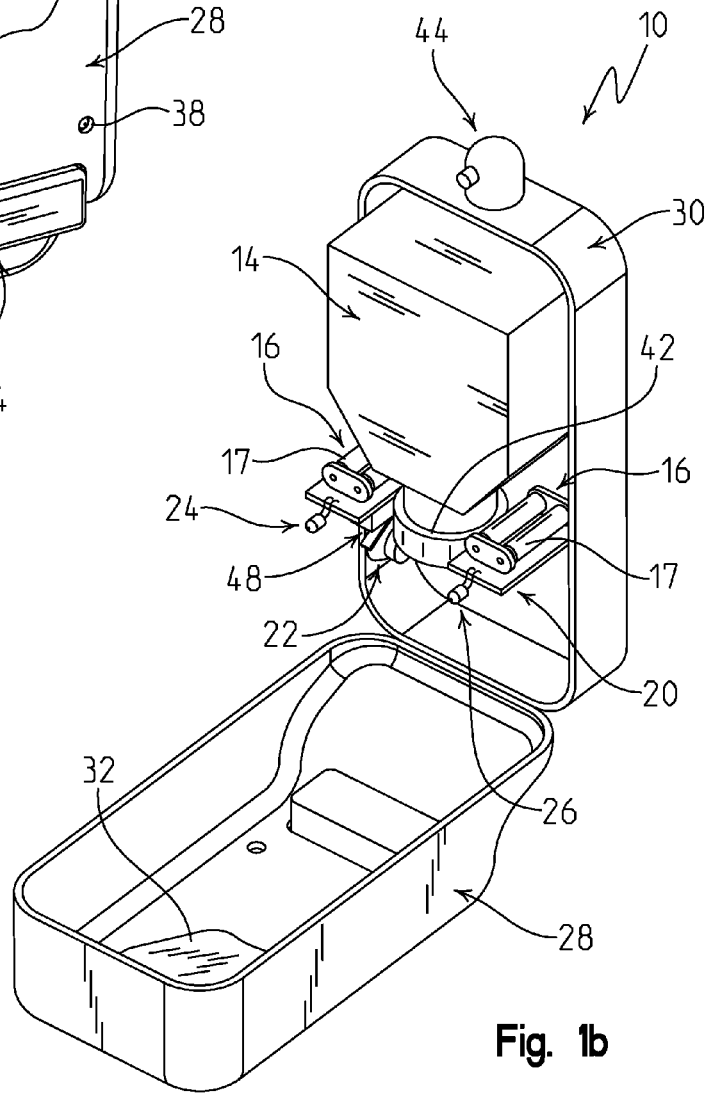

FIG. 1 shows hygiene maintenance device 10. Hygiene maintenance device 10 is shown as a dispenser of soap or hand rub such as an antiseptic hand rub. Device 10 provides an auditory and visual reminder to use it, an alcohol (or otherwise) based hand rub and a compliance monitoring system all in one unit.

Device 10 is wall mounted or on an independent portable stand close to the entrance to a patient's room. Device 10 includes housing 12, sanitizer container 14, battery holders 16, batteries 17, circuit board 20, speaker 22, status LED 24, and fault LED 26.

Housing 12 is substantially similar to soap/alcohol dispensers known in the art. Housing 12 includes a front half 28 pivotally coupled to a back half 30. Front half 28 includes window 32, dispensing handle 34, and LED windows 36, 38. Front half 28 pivots relative to back half 30 to allow access to the interior of housing 12 for servicing of device 10, including fixing malfunctions, refilling/replacing sanitizer container 14, and replacing batteries 17. Window 32 allows a user to see therethrough to see sanitizer container 14. Dispensing handle 34 is pressed by a user's hand to cause dispensing of sanitizer from device 10. Alternatively, handle 34 is hingedly coupled to back half 30. LED windows 36, 38 align with LED's 24, 26 when front half 28 is in a closed position to allow a user to view light produced by LED's 24, 26 through LED windows 36, 38, respectively.

Back half 30 includes sanitizer container mount 42, sanitizer container 14, battery holders 16, circuit board 20, speaker 22, LED's 24, 26, sensor/emitter 44, and speaker port 40. Sanitizer mount 42 provides a quick disconnect mount that readily receives and releases sanitizer container 14 while providing a leak-free connection for sanitizer container 14 that allows dispensing of the contents of sanitizer container 14. Sanitizer container 14 is either a disposable or refillable container of the sanitizer to be dispensed by device 10. Battery holders 16 hold batteries 17 and are electrically coupled to circuit board 20. Circuit board 20 includes a processor 46 thereon as well as a plurality of input/output/power ports. The input/output/power ports are coupled to portions for detection (such as sensor/emitter 44), for providing alerts (such as LED's 24, 26, speaker 22), for powering the device (such as battery holders 16 and batteries 17), for determining the amount of sanitizer remaining in sanitizer container 14, for communicating with other devices, and for saving data. Speaker 22 is coupled to circuit board 20 and provides audible commands or alerts, or information generally. Status LED 24 provides an indication of the operational status of hygiene maintenance device 10. Status LED 24 can operate in a plurality of ways. Such ways include providing a solid-on state and various combinations of flashes to indicate various operational states, or by producing various colors to indicate various operational states. Similarly, fault LED 26 provides an indication of operational faults or low battery/power (or loss of power). LED 26 can communicate this in any of the ways described with respect to status LED 24. Sensor/emitter 44 is located at the top of back half 30 and is illustratively an infrared motion sensor/emitter. Sensor/emitter 44 therefore emits an infrared signal and then senses the signal that is reflected by the surroundings back to sensor/emitter 44. More specifically, sensor/emitter 44 utilizes infrared sensing technology across a narrow spectrum (multiple "rays") to detect an object moving through its field. The sensor chosen for this prototype is "tuned" more specifically towards the heat signature of a person to limit detection of a moving door or moving piece of equipment. Optionally, a second electrically coupled sensor/emitter 44 is also used. Speaker port 40 aligns with speaker 22 to readily allow sounds to emanate therefrom.

Whereas one embodiment of the device is described above, various alternatives are envisioned. More specifically, whereas the sensor/emitter 44 is described as a motion sensor device, other embodiments are envisioned such as those using a light gate, RFID, ultrasound, a thermal sensor, or any other suitable sensor known in the art. Furthermore, whereas sensor/emitter 44 is described as being integrated with hygiene maintenance device 10, embodiments are envisioned where sensor/emitter 44 is separate from hygiene maintenance device 10 and is able to be positioned remotely from hygiene maintenance device 10. Sensor/emitter 44 can have a fixed aim or can be adjustable such that the coverage thereof can be adjusted once installed. Each of the detection methods provide opportunities to customize the detection profiles (the conditions under which a detection of a user is considered to have been triggered). The detection profiles can either be fixed as a factory setting or can be adjustable by an installer or other individual to customize hygiene maintenance device 10 to suit its particular application setting.

Additionally, LED's 24, 26 and speaker 22 can provide different ways of signaling that a detection has been made. As previously noted, LED's 24, 26 can provide solid on or off settings, as well as flash patterns, and differing colors to indicate various things. Similarly, audible alerts provided via speaker 22 can be provided in the form of tones, music, or voice prompts. Additionally, multiple alerts can be provided and the timing of such alerts relative to other events can either be a factory setting or adjustable by an installer or user.

The embodiment of FIG. 1 shows batteries 17 and battery holders 16. Alternatively or additionally, power can be provided via a traditional AC plug or a power cord that couples to a PC (USB or otherwise). Thus, batteries 17 can be either a primary or a secondary (backup) power source.

Figure 4:
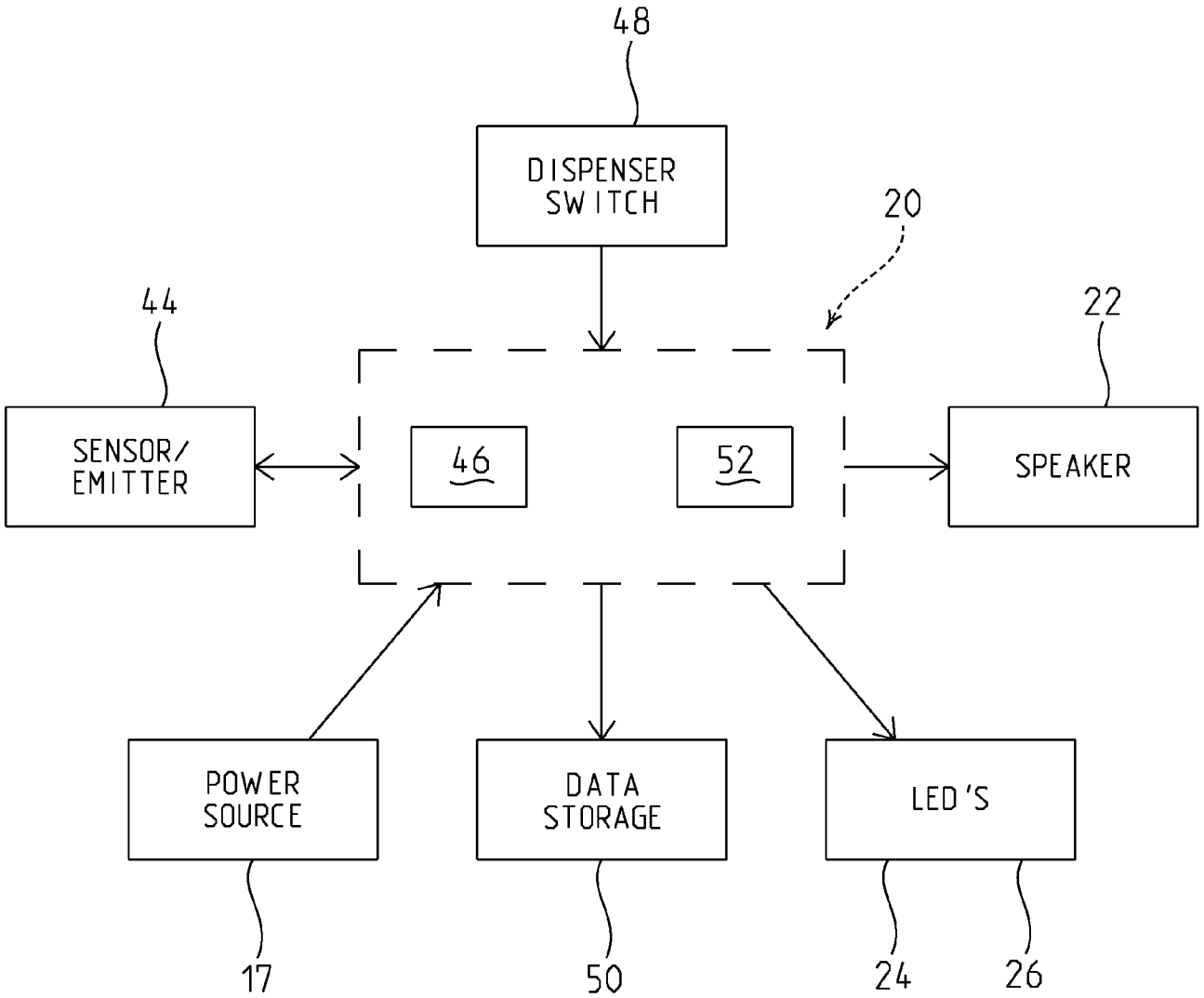
FIG. 4 is a schematic diagram of the inputs and outputs for a microprocessor and a circuit board of the hygiene maintenance device of FIG. 1.

Circuit board 20, FIG. 4, is coupled to storage component 50 and includes communications components 52 thereon. Storage components 50 store the programming used to operate hygiene maintenance device 10 and store configuration settings. Storage components 50 also store operational data indicative of how hygiene maintenance device 10 has been used or unused and data relating to compliance with a proscribed use protocol. Embodiments are envisioned where device 10 includes removable memory such as a memory card/stick or jump drive for storing data. Such embodiments optionally operate without an infrastructure for networked monitoring. In still another embodiment, processor 46 detects the connection of a jump drive (or thumb drive) connected via a USB port or otherwise and automatically uploads stored data thereto. Such embodiment would additionally operate without the need for a dedicated computer or network infrastructure.

Communications components 52 allow data to be transferred between hygiene maintenance device 10 and other computing devices, such as a central computer coupled to a plurality of hygiene maintenance devices 10. Use of communications components 52 allows data to be saved to or pulled from storage components 50. Communication components 52 include components for wired or wireless networking, or for direct coupling to a computer. The wired components are those for connection to a LAN or Ethernet based system (such as an RJ-45 interface). Wireless networking components are those for traditional Wi-Fi or a wireless MESH network (WMN) operating according to the Zigbee standard or otherwise. Direct coupling components are those suitable for providing USB, Serial, firewire, or other known transmission interfaces. Device 10 can communicate directly to another computer via the direct connection for purposes of downloading stored data or changing the program presets. (i.e. a user can connect to an individual device via a USB cable connected to their laptop or portable computer.) Such embodiments optionally operate without an infrastructure for networked monitoring Device 10 further includes switch 48 that is coupled to or integral with dispensing handle 34. Switch 48 is a limit switch, a micro switch, a position switch, or any other suitable switch. Switch 48 allows detection of the use of dispensing handle 34 and thus the dispensing of sanitizer. Software also receives input from switch 48 to count the number of times dispensing handle 34 is pressed and uses information regarding the last refill/replacement of sanitizer container 14 to produce an approximation on the amount of sanitizer remaining in sanitizer container 14. Accordingly, appropriate staff can be alerted when sanitizer container 14 is running low on sanitizer.

Device 10 operates to monitor ingress and egress from a hygiene sensitive area. If the sensor/emitter 44 detects a user passing within its sensing range, and if a sanitizer is not dispensed within a specified period of time, a voice alarm in English (and/or in other appropriate languages) with an adjustable, time-cycled volume control says "You must cleanse hands." Alternatively, an audible tone is presented instead. In addition, a visual alarm is activated. If the sanitizer is not dispensed after 2 warnings, a "non-compliant event" is recorded and stored. All "compliant events" are recorded and stored as well. Logs of events are stored in the storage components. The logs are stored as .csv, .txt, or other file types as desired. Furthermore, the logs provide records of each event including the unique ID of hygiene maintenance device 10, date and time of the event, whether an audible alert was presented, whether detection sensor detected an individual, whether the detection resulted in a compliant or non-compliant sanitizer use, approximate sanitizer remaining in sanitizer container 14, and any other data deemed useful by the operator.

Figure 2:
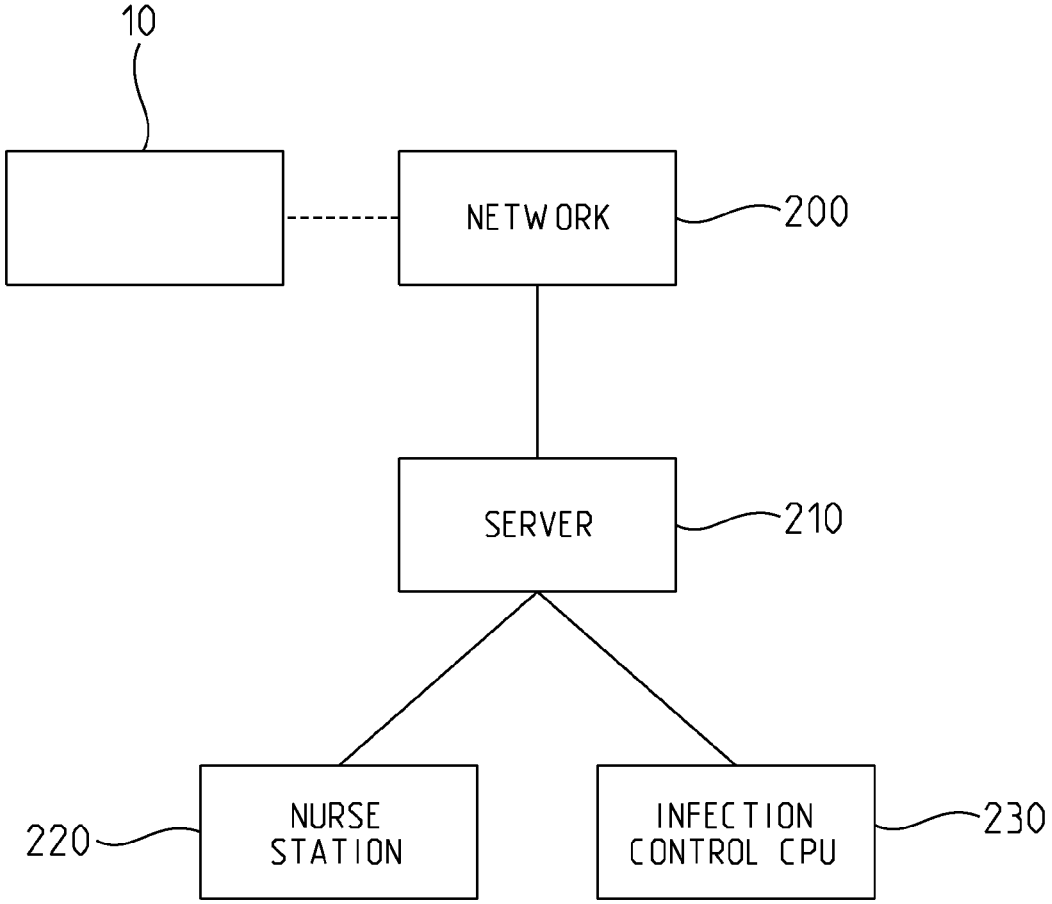
FIG. 2 is a schematic of computing systems in communication with the hygiene maintenance device of FIG. 1.

Device 10 continuously monitors compliance and transmits the logged information via the communication components to local and/or central computers so compliance rates can be monitored for a particular room, a particular unit/ward, and/or the whole hospital on a regular basis. FIG. 2 shows an example setup for the network setup. Device 10 communicates in any of the above described ways to network 200. Server 210 is coupled to network 200. Various other computers access server 210 either in real-time or at a later time to access the compliance and operational data. Unit nurses' station computer 220 is primarily used to monitor operational status of devices 10. Faults in device 10 and low sanitizer warnings are provided to computer 220 to inform of the need for maintenance of device 10. However, compliance data, real time or historical, can also be provided to computer 220 if desired. Real time compliance data can be useful for prompting staff to encourage compliance or to educate non-healthcare workers (such as visitors) regarding hygiene requirements. Infection control computer 230 is provided as a device to access, synthesize, and produce reports regarding the compliance data. The programming of infection control computer 230 can include programs that are set to monitor data in server 210 for certain conditions and generate remedial protocols or note particularly well performing areas. Infection control computer 230 generally allows for manipulation of the data of server 210.

Figure 5A:
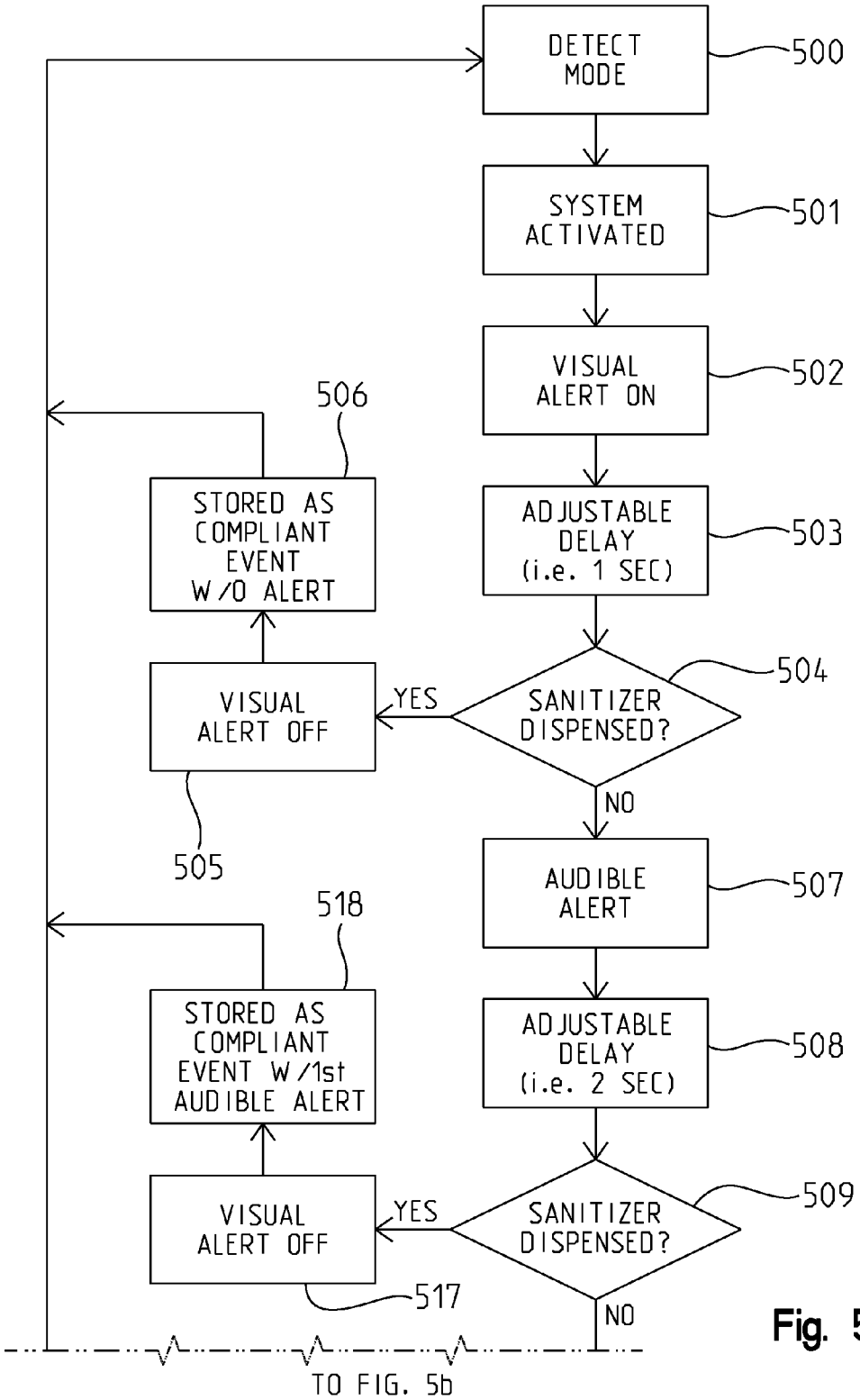
FIG. 5*a&b* are a decision tree showing the functional process followed by the hygiene maintenance device of FIG. 1.
Figure 5B:
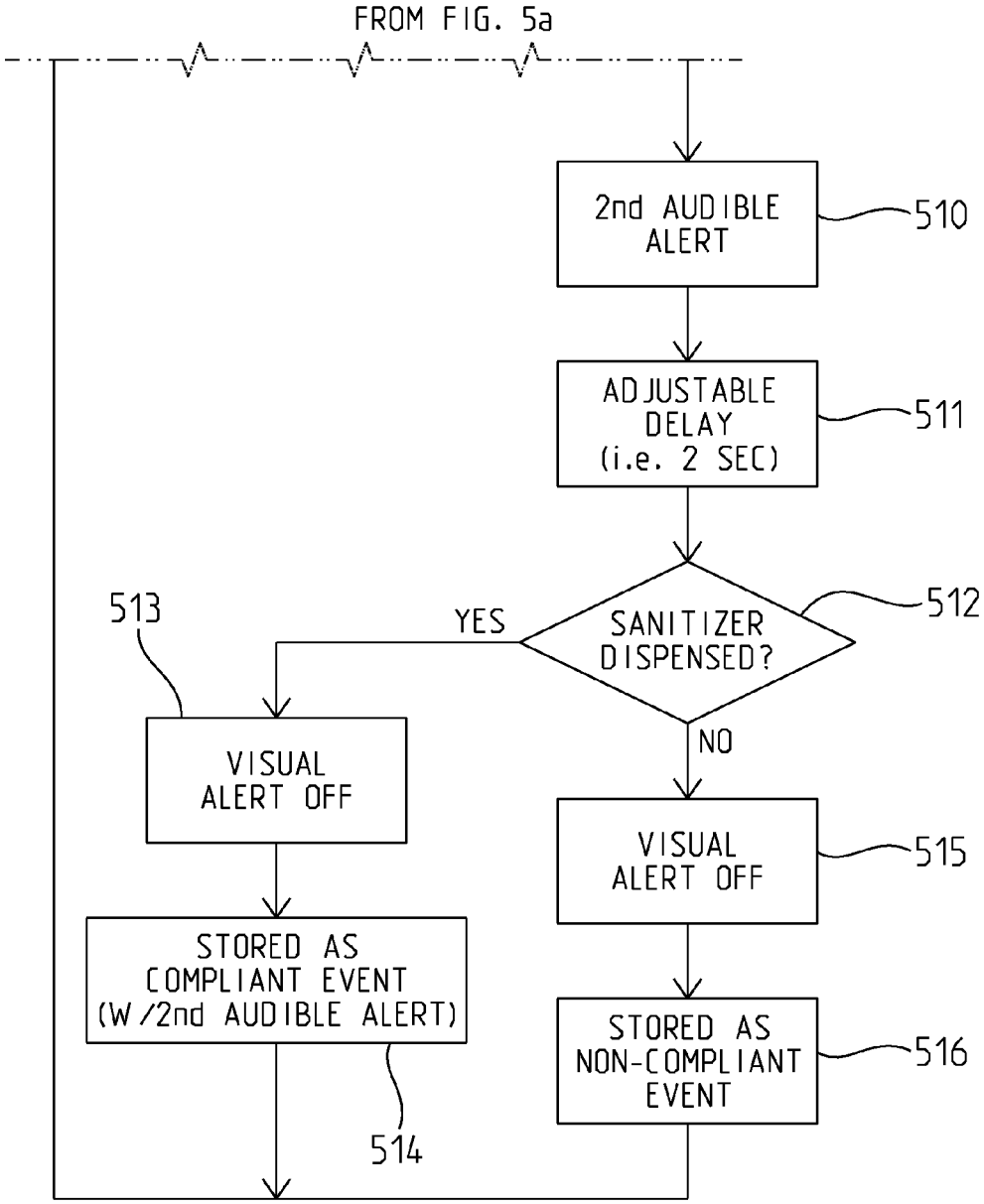

The definition for a compliant event can be adjusted and dictated by the owner of device 10. One protocol for determining the compliant/non-compliant status of an event is shown in FIG. 5. The processor runs the program and sits in detect mode 500 waiting for an activation. The processor activates the system when sensor/emitter 44 detects the presence of an individual within its capture zone, step 501. This results in the activation of LED 24 by the processor, step 502. The processor then waits a delay time, step 503. The delay time is adjustable and can be customized on a site, ward, room, or other basis. An exemplary delay time is provided as one second. The processor then checks to see if switch 48 has been triggered, step 504. If switch 48 has been triggered, then the processor turns off the visual alert, step 505 and stores the event in the event log as a compliant event without alert, step 506. The processor then returns to detect mode 500.

If switch 48 has not been triggered, then the processor sounds an audible alert, step 507. The processor then waits a delay time, step 508. The processor then again checks to see if switch 48 has been triggered, step 509. If switch 48 has been triggered, then the processor turns off the visual alert, step 517 and stores the event in the event log as a compliant event with first audible alert, step 518.

If switch 48 has not been triggered at the point of step 507, then the processor sounds a second audible alert, step 510. The processor then waits a delay time, step 511. The processor then again checks to see if switch 48 has been triggered, step 512. If switch 48 has been triggered, then the processor turns off the visual alert, step 513 and stores the event in the event log as a compliant event with a second audible alert, step 514. The processor then returns to detect mode 500.

If switch 48 has not been triggered at the point of step 512, then the processor turns off the visual alert, step 515 and stores the event in the event log as a non-compliant event, step 516. The processor then returns to detect mode 500.

When compliance rates are below appropriate levels in a certain area, additional training is instituted in those units and follow-up compliance rates are then monitored. The device also has a visual alarm, LED 26, indicating a low level of sanitizer so that the unit can be refilled or indicating if there is a malfunction detected. An auditory alarm will sound, via speaker 22, if the sanitizer is not replaced in a specified amount of time or if the malfunction is not fixed.

Similarly, in embodiments where device 10 uses AC power from a wall outlet an alarm sounds if device 10 becomes unplugged.

Initially, close to the time of implementation, there would be expected to be a number of alarms triggered. However, these alarm instances would be expected to decrease as the task became a learned behavior. It would also ensure that this reminder remained present if compliance rates decreased due to factors such as new personnel or times of understaffing or overcrowding.

As evidenced by the above described example protocol, detection of a user initiates the protocol. Accordingly, accurate and reliable detection of the user is needed. Accordingly, the positioning of sensor/emitter 44 can affect the operation of the system. Positioning of sensor/emitter 44 is determined by taking the layout of the monitored area into account. FIGS. 3*a-f* show various positioning options usable with various area layouts.

Figure 3A:
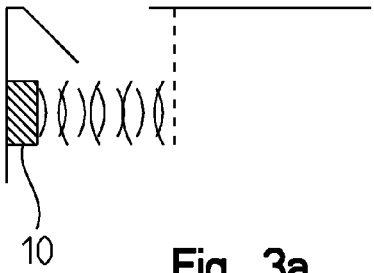
FIGS. 3*a-f* are overhead schematic views of embodiments of room setups using the hygiene maintenance device of FIG. 1.

FIG. 3*a* shows a room layout without impediments or interior walls near the ingress/egress door of the room. Device 10 is placed proximate the door on a wall that is 90-degrees relative to the door to the room. Sensor/emitter 44 is provided as a two-part sensor/emitter 44 that provides two beams in the detection zone. The two beams optionally allow directionality to be discerned for a user that traverses the detection zone. In sum, hygiene maintenance device 10 is positioned such that anyone entering or leaving the room necessarily enters the detection zone. The arrangement shown in FIG. 3*a* shows an arrangement using an IR, ultrasonic, light gate, motion, thermal, or RFID detection method. Sensor/emitter 44 is optionally configured to provide a distance parameter such that movement beyond a defined distance is not captured. This prevents general movement within the room but away from the door from triggering the device. FIG. 3*d* shows similar hygiene maintenance device 10 positioning with a differing angle adjustment of sensor/emitter 44.

Figure 3B:
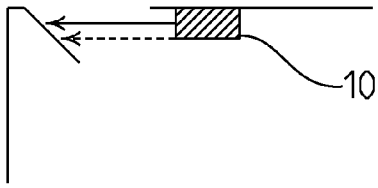

FIG. 3*b* shows a positioning suitable most readily for RFID detection method. Device 10 is located proximate the door on the same wall as the door. (It should be appreciated that "door" is being used as a generic term for an egress point. Furthermore, while placement of device 10 on walls is discussed, embodiments are envisioned where device 10 is on a moveable stand but oriented relative to an egress point consistently with the provided examples herein.) While FIG. 3*b* is described as being most readily suitable for RFID, the adjustable nature of sensor/emitter 44 provides that the other detection methods may also be usable with such placement. FIG. 3*d* shows device 10 having similar placement, with sensor/emitter 44 being adjusted to define different detection zones. Somewhat similarly, FIG. 3*f* shows similar positioning of hygiene maintenance device 10 that uses remote sensor/emitter 44. These remote sensor/emitter 44 are wired or wirelessly coupled to hygiene maintenance device 10. As shown in FIG. 3*f*, the use of remote sensor/emitter 44 allows multiple positions for hygiene maintenance device 10. (While FIG. 3*f* shows multiple hygiene maintenance device 10, only one would need to be coupled to remote sensor/emitter 44.)

Figure 3C:
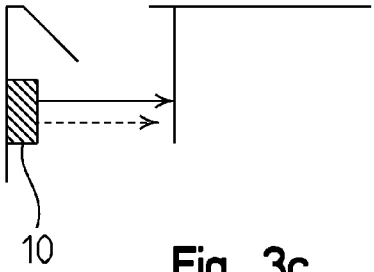
Figure 3D:
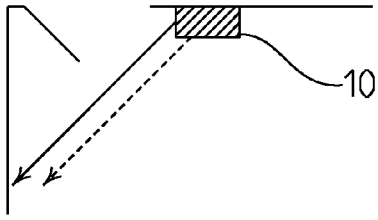
Figure 3E:
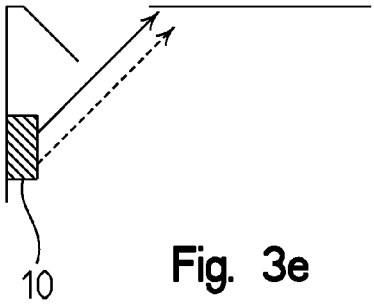
Figure 3F:
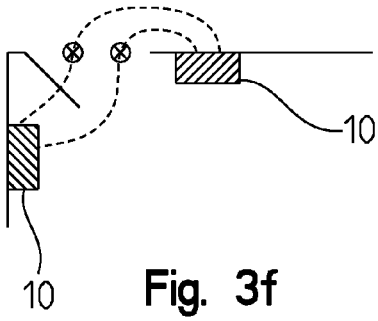

FIG. 3*c* shows a positioning suitable when the ingress/egress point includes an internal hallway. Remote sensor/emitter 44 is positioned to create a detection zone across the hallway. The embodiments of FIGS. 3*a-f* are exemplary and not intended to be exhaustive.

Besides hospitals and other medical environments, device 10, in various forms, could have applicability for nursing homes, food-handling areas including restaurants, schools, child care facilities and any other areas where hand hygiene is important for infection control. It may also be applicable in some "clean room" manufacturing environments.

Additionally, devices 10 will have the ability to adjust the voice alarm volume with an internal 24 hour clock so that the voice alarm volume can be lowered or silenced as desired, such as at night for patient comfort. Via the network or direct connectivity, devices 10 can be volume adjusted on the room, ward, hospital, or other level. This 24 hour clock will also be helpful in determining compliance rates during different time periods. The unit further has a visual alarm to indicate when the device is running low on hand rub and an auditory alarm if dispenser is not refilled in a specified period of time or there is a unit malfunction.

Although the invention has been described in detail with reference to certain preferred embodiments, variations and modifications exist within the spirit and scope of the invention as described and defined in the following claims.

What is claimed is:

1. A hygiene compliance device including:

a housing;

a hygiene maintenance material holder located within the housing;

an interface member coupled to the housing that, when activated by a user, causes distribution of hygiene maintenance material from within the hygiene maintenance material holder to the user;

an interface member sensor coupled to the housing that detects activation of the interface member;

a signal emitter coupled to the housing;

a signal sensor coupled to the housing that cooperates with the signal emitter to detect the presence of a person in a detection zone;

a circuit board located within the housing and coupled to the signal emitter, the signal sensor, and the interface member sensor, the circuit board including a processor; and a data storage unit located within the housing and electronically coupled to the processor, the data storage unit having instructions thereon that, when interpreted by the processor cause the processor to perform the steps of:

issuing commands to the signal emitter to emit a signal;

receiving data from the signal sensor;

detecting activation of the interface member sensor;

creating a record that provides an approximation of the amount of hygiene maintenance material remaining in the hygiene maintenance material holder;

determining if the interface member sensor is activated within a first preset time of a detection of an individual within the detection zone; and choosing between and executing one of:

a) logging a compliant event by saving a record to the data storage unit if the interface member is activated within the first preset time of the detection of the individual in the zone; and b) issuing an alert detectable by the individual if the interface member is not activated within the first preset time of the detection of the individual in the detection zone;

wherein the approximation is generated by the processor by considering a volume of hygiene maintenance material present in a full hygiene maintenance material holder, a volume of hygiene material dispensed per activation of the interface member, and the number of interface member sensor activations since filling of the hygiene maintenance material holder.

2. A hygiene compliance device including:

a housing;

a hygiene maintenance material holder located within the housing;

an interface member coupled to the housing that, when activated by a user, causes distribution of hygiene maintenance material from within the hygiene maintenance material holder to the user;

an interface member sensor coupled to the housing that detects activation of the interface member;

a signal emitter coupled to the housing;

a signal sensor coupled to the housing that cooperates with the signal emitter to detect the presence of a person in a detection zone;

a circuit board located within the housing and coupled to the signal emitter, the signal sensor, and the interface member sensor, the circuit board including a processor; and a data storage unit located within the housing and electrically coupled to the processor, the data storage unit having instructions thereon that, when interpreted by the processor cause the processor to perform the steps of:

issuing commands to the signal emitter to emit a signal;

receiving data from the signal sensor;

processing the data received from the signal sensor to determine if an individual is located within a detection zone of the sensor;

detecting activation of the interface member sensor;

determining if the interface member sensor is activated within a first preset time of a detection of an individual within the detection zone; and choosing between and executing one of:

a) logging a compliant event by saving a record to the data storage unit if the interface member is activated within the first preset time of the detection of the individual in the detection zone; and b) issuing an alert detectable by the individual if the interface member is not activated within the first preset time of the detection of the individual in the detection zone and after issuing an alert detectable by the individual, the instructions further cause the processor to perform the step of choosing between and executing one of:

i) logging a compliant event by saving a record to the data storage unit if the interface member is activated within a second preset time of the detection of the individual in the detection zone; and ii) issuing an alert detectable by the individual if the interface member is not activated within the second preset time of the detection of the individual in the detection zone.

3. The device of claim 2, wherein the instructions further cause the processor to perform the step of choosing between and executing one of:

a) logging a compliant event by saving a record to the data storage unit if the interface member is activated within a third preset time of the detection of the individual in the detection zone, the saved record noting that an alert was issued; and b) logging a non-compliant event by saving a record to the data storage unit if the interface member is not activated within the third preset time of the detection of the individual in the detection zone.

4. The device of claim 3, wherein the housing includes a front portion hingedly coupled to a back portion.

5. The device of claim 3, further including a communications module, the communications module providing for transmission of records from the data storage unit to a remote database.

6. The device of claim 3, wherein the record includes a unique ID indicative of the device in which the record was generated, the date and time of record generation, and whether an alert was issued by the device.

7. The device of claim 1, wherein the processor further generates an alert upon determining that the processor generated approximation of the amount of hygiene maintenance material remaining in the hygiene maintenance material holder indicates an amount below a threshold amount.

8. The device of claim 7, wherein the processor is electrically coupled to a communications module, the processor transmitting the alert to a monitor computer via the communications module.

9. The device of claim 1, wherein the detection zone is an area identified as likely to contain biological pathogens.

10. The device of claim 1, wherein the detection zone is an entryway for an area.

11. The device of claim 1, wherein the choosing is performed without reference to any specific item worn and/or possessed by the user.

12. The device of claim 1, wherein issuing an alert detectable by the individual includes at least one of providing a visual indication on a housing of the hygiene compliance device that contains the hygiene maintenance material and providing an audio indication emanating from the housing of the hygiene compliance device that contains the hygiene maintenance material.

13. A hygiene compliance device including:

a housing;

a hygiene maintenance material holder located within the housing;

an interface member coupled to the housing that, when activated by a user, causes distribution of hygiene maintenance material from within the hygiene maintenance material holder to the user;

an interface member sensor coupled to the housing that detects activation of the interface member;

a signal emitter coupled to the housing;

a signal sensor coupled to the housing that cooperates with the signal emitter to detect the presence of a person in a detection zone;

a circuit board located within the housing and in communication with the signal emitter, the signal sensor, and the interface member sensor, the circuit board including a processor;

a communications module, the communications module providing for transmission of records from the device to a remote database; and a data storage unit located within the housing and electrically coupled to the processor and in communication with the communications module, the data storage unit having instructions thereon that, when interpreted by the processor cause the processor to perform the steps of:

issuing commands to the signal emitter to emit a signal;

receiving data from the signal sensor;

processing the data received from the signal sensor to determine if an individual is located within a detection zone of the sensor;

detecting activation of the interface member sensor;

determining if the interface member sensor is activated within a first preset time of a detection of an individual within the detection zone; and choosing between and executing one of:

a) logging a compliant event by saving a record to the data storage unit if the interface member is activated within the first preset time of the detection of the individual in the detection zone; and b) issuing an alert detectable by the individual if the interface member is not activated within the first preset time of the detection of the individual in the detection zone and after issuing an alert detectable by the individual, the instructions further cause the processor to perform the step of choosing between and executing one of:

i) logging a compliant event by saving a record to the data storage unit if the interface member is activated within a second preset time of the detection of the individual in the detection zone; and ii) issuing an alert detectable by the individual if the interface member is not activated within the second preset time of the detection of the individual in the detection zone.

14. The device of claim 13, wherein the instructions further cause the processor to perform the step of choosing between and executing one of:

a) logging a compliant event by saving a record to the data storage unit if the interface member is activated within a third preset time of the detection of the individual in the detection zone, the saved record noting that an alert was issued; and b) logging a non-compliant event by saving a record to the data storage unit if the interface member is not activated within the third preset time of the detection of the individual in the detection zone.

15. The device of claim 13, wherein the housing includes a front portion hingedly coupled to a back portion.

16. The device of claim 13, wherein the record includes a unique ID indicative of the device in which the record was generated, the date and time of record generation, and whether an alert was issued by the device.

17. A hygiene compliance device including:

a housing;

a hygiene maintenance material holder located within the housing;

an interface member coupled to the housing that, when activated by a user, causes distribution of hygiene maintenance material from within the hygiene maintenance material holder to the user;

an interface member sensor coupled to the housing that detects activation of the interface member;

a signal emitter coupled to the housing;

a signal sensor coupled to the housing that cooperates with the signal emitter to detect the presence of a person in a detection zone;

a circuit board located within the housing and coupled to the signal emitter, the signal sensor, and the interface member sensor, the circuit board including a processor; and a data storage unit located within the housing and electronically coupled to the processor, the data storage unit having instructions thereon that, when interpreted by the processor cause the processor to perform the steps of:

issuing commands to the signal emitter to emit a signal;

receiving data from the signal sensor;

detecting activation of the interface member sensor;

creating a record that provides an approximation of the amount of hygiene maintenance material remaining in the hygiene maintenance material holder;

determining if the interface member sensor is activated within a first preset time of a detection of an individual within the detection zone; and choosing between and executing one of:

a) logging a compliant event by saving a record to the data storage unit if the interface member is activated within the first preset time of the detection of the individual in the zone; and b) issuing an alert detectable by the individual if the interface member is not activated within the first preset time of the detection of the individual in the detection zone;

wherein the approximation is generated by the processor by considering a volume of hygiene maintenance material present in a full hygiene maintenance material holder, a volume of hygiene material dispensed per activation of the interface member, and the number of interface member sensor activations since filling of the hygiene maintenance material holder; and wherein the processor further generates an alert upon determining that the processor generated approximation of the amount of hygiene maintenance material remaining in the hygiene maintenance material holder indicates an amount below a threshold amount.

18. The device of claim 17, wherein the processor is electrically coupled to a communications module, the processor transmitting the alert to a monitor computer via the communications module.

19. The device of claim 17, wherein the detection zone is an area identified as likely to contain biological pathogens.

20. The device of claim 17, wherein the detection zone is an entryway for an area.

21. The device of claim 17, wherein the choosing is performed without reference to any specific item worn and/or possessed by the user.

22. The device of claim 17, wherein issuing an alert detectable by the individual includes at least one of providing a visual indication on a housing of the hygiene compliance device that contains the hygiene maintenance material and providing an audio indication emanating from the housing of the hygiene compliance device that contains the hygiene maintenance material.

* * * * *